US006987453B1

(12) United States Patent
Altwasser

(10) Patent No.: US 6,987,453 B1
(45) **Date of Patent: *Jan. 17, 2006**

(54) SECURITY ELEMENT FOR ELECTRONIC SURVEILLANCE OF ARTICLES

(75) Inventor: Richard Altwasser, Oxon (GB)

(73) Assignee: Checkpoint Systems International GmbH, Hirschhorn/Neckar (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/135,083

(22) Filed: Apr. 29, 2002

Related U.S. Application Data

(63) Continuation of application No. PCT/EP00/09522, filed on Sep. 28, 2000.

(30) Foreign Application Priority Data

Oct. 27, 1999 (DE) ..... 199 51 561

(51) Int. Cl.
*G08B 13/14* (2006.01)

(52) U.S. Cl. ..... 340/572.1; 340/572.5; 340/572.7; 340/572.8; 324/652; 343/866

(58) Field of Classification Search ..... 340/572.1, 340/572.7, 572.8, 572.5, 10.42, 505; 29/829; 343/873, 895, 872, 741, 866; 428/40.1, 672, 428/137; 324/652, 653, 649
See application file for complete search history.

(56) References Cited

U.S. PATENT DOCUMENTS

| | | | | |
|---|---|---|---|---|
| 4,990,891 | A * | 2/1991 | Reeb | 340/572.5 |
| 5,291,180 | A | 3/1994 | Reeb | |
| 5,574,431 | A * | 11/1996 | McKeown et al. | 340/572.1 |
| 5,734,327 | A * | 3/1998 | Batterink et al. | 340/572.5 |
| 5,838,253 | A * | 11/1998 | Wurz et al. | 340/825.54 |
| 6,025,725 | A * | 2/2000 | Gershenfeld et al. | 324/652 |
| 6,031,458 | A * | 2/2000 | Jacobsen et al. | 340/572.5 |
| 6,034,651 | A * | 3/2000 | Enguent | 340/572.7 |
| 6,147,655 | A * | 11/2000 | Roesner | 343/741 |
| 6,373,387 | B1 * | 4/2002 | Qiu et al. | 340/572.1 |
| 6,384,727 | B1 * | 5/2002 | Diprizio et al. | 340/572.7 |
| 6,414,596 | B1 | 7/2002 | Altwasser et al. | |

FOREIGN PATENT DOCUMENTS

| | | |
|---|---|---|
| DE | 322 21 500 A1 | 12/1983 |
| DE | 197 08 180 A1 | 5/1998 |
| DE | 197 19 434 A1 | 11/1998 |
| EP | 0 665 705 A2 | 12/1994 |
| EP | 0 913 711 A1 | 5/1999 |

* cited by examiner

*Primary Examiner*—Davetta W. Goins
(74) *Attorney, Agent, or Firm*—Caesar, Rivise, Bernstein, Cohen & Pokotilow, Ltd.

(57) ABSTRACT

A radio frequency security element is provided for electronic surveillance of articles of merchandise. The security element comprises a lower strip conductor (1) and an upper strip conductor (5), which are wound in opposite directions. The upper and lower strip conductors and superimposed and connected in a common contact zone. The coil turns of the two conductor strips each have an included angle of rotation less than $2\pi$. The security element has an improved detection rate and is particularly stable against changes in the resonance frequency.

15 Claims, 1 Drawing Sheet

SECURITY ELEMENT FOR ELECTRONIC SURVEILLANCE OF ARTICLES

CROSS-REFERENCE TO RELATED APPLICATIONS

This application is a continuation of International Application No. PCT/EP00/09522, filed Sep. 28, 2000, the disclosure of which is incorporated herein by reference.

BACKGROUND OF THE INVENTION

This invention relates to a security element for electronic article surveillance.

German published patent application DE 197 08 180 A1, for example, discloses a suitable security element comprising one lower conducting track and one upper conducting track, wherein the conducting tracks have a contact zone and, connected thereto, respective coil turns (windings) with opposite winding directions. The conducting tracks are superimposed, and an electrical connection exists between the lower conducting track and the upper conducting track in the area of the contact zone. The entire security element has at least one coil turn with an included angle of rotation of $2\pi$. Security elements of this type are referred to as resonant circuits or radio frequency (RF) security elements, the resonant frequency being determined by the capacitance C, the inductance L and the resistance R of the resonant circuit.

Radio frequency security elements in the form of labels or tags are used in the prevention and detection of theft in department stores and warehouses, and they are becoming increasingly popular as the result of their high rates of detection.

Article surveillance itself can be described briefly as follows. In the interrogation zone of the area to be maintained under surveillance—this is conventionally the entrance and exit area of a department store or warehouse—the radio frequency security elements are excited by an alternating magnetic field into emitting a characteristic recognition signal. Once this characteristic signal is detected by the surveillance system, an alarm is produced. Visible to the visitor of a department store or warehouse are two columns of the surveillance system, through which each person wishing to leave the department store or warehouse must pass.

Essential for the detection rate of the surveillance system are the spatial distances between the above-mentioned columns, the level of existing disturbances and the performance of the RF security element.

One possibility for increasing the detection rate is to increase the dimensions of the security element. The disadvantage of this solution is the increased cost for the security element and, in addition, the difficulty encountered in equipping merchandise of small outer dimensions with such large security elements. Another disadvantage of the known RF security elements is the risk of the resonant frequency of the security elements being detuned, i.e., altered, by the presence of an electrically conducting mass in the vicinity of the security element. A knowledgeable shoplifter may utilize this effect by taking the security element in his hand, thereby reducing the detection rate drastically. Furthermore, it proves difficult to detect security elements of the type described with sufficient reliability when they are attached to products with a high water content. Such high water content products include, for example, meat, fish or drink bottles.

BRIEF SUMMARY OF THE INVENTION

It is therefore an object of the present invention to provide a security element which has an improved detection rate, while its dimensions are the same as those of the known security elements.

This object is accomplished according to the present invention by a security element for electronic article surveillance, which comprises one lower conducting track and one upper conducting track, wherein the conducting tracks have a common contact zone and, laterally contiguous thereto, respective coil turns with opposite winding directions. The conducting tracks are superimposed, and an electrical connection exists between the lower conducting track and the upper conducting track in the area of the contact zone. The angle of rotation included by each of the two coil turns is respectively less than $2\pi$.

By reducing the angle of rotation included by the coil turns to less than $2\pi$, and by having the two coil turns with different winding directions, each laterally contiguous with the contract zone, the surface area enclosed by the coil turns increases and with it the effective volume $V_{eff}$. This significantly improves the detection rate of the security element.

The effective volume $V_{eff}$ [$m^3$] is an important parameter in the assessment of the performance of an RF security element. The effective volume $V_{eff}$ is defined as the quotient of the magnetic moment emitted by the security element and the field strength H of the magnetic field in which the security element is present.

The increase in the effective volume $V_{eff}$ reduces the sensitivity of the surveillance system to disturbances, enables the columns to be arranged at a greater relative distance, or it increases the detection rate of the surveillance system under otherwise like conditions. With the configuration of the security element according to the invention, the effective volume $V_{eff}$ is increased by about 20% as compared to known RF security elements.

In one embodiment of the invention a dielectric layer is provided between the lower conducting track and the upper conducting track except in the contact zone, thereby reliably preventing an electrical connection between the conductors at a place other than the contact zones. Particularly advantageously, the dielectric layer is constructed as an adhesive layer, a dielectric film, in particular made of polyethylene terephthalate (PET), and/or a dielectric lacquer layer, which provides for electric insulation in a simple and effective way.

One embodiment of the invention provides for the thickness of the dielectric layer to be smaller than or equal to 2 $\mu$m, so that the capacitance of the resonant circuit formed by the conductors is increased. Moreover, influences on the resonant frequency by electrically conducting masses present in the vicinity of the security element are materially reduced.

According to a further feature of the invention, provision is made for the conducting tracks to be connected electrically in the area of the contact zones by perforations, whereby a reliable and low-cost electrical connection with high mechanical load-carrying ability is established.

Further advantages and advantageous embodiments of the invention will become apparent from the accompanying drawings, and the following description and claims.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
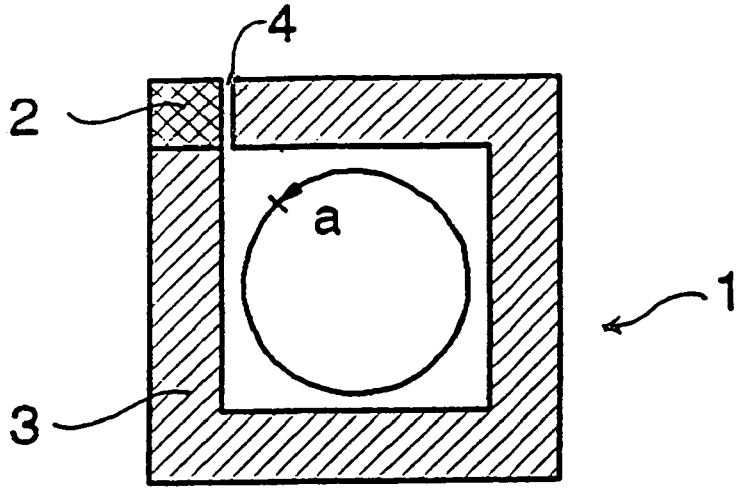
FIG. 1 is a plan view of the lower conducting track in accordance with a preferred embodiment of the security element of the invention.

FIG. 1 shows a plan view of a lower conducting track 1. The lower conducting track 1 is stamped out from an aluminum foil of a thickness of about 38 $\mu$m. The lower conducting track 1 has a contact zone 2 within which electrical contact exists between the lower conducting track 1 and an upper conducting track not shown in FIG. 1.

Starting from the contact zone 2, the lower conducting track 1 is wound in the counterclockwise direction. The angle of rotation "a" included by the coil turn 3 is less than $2\pi$.

Figure 2:
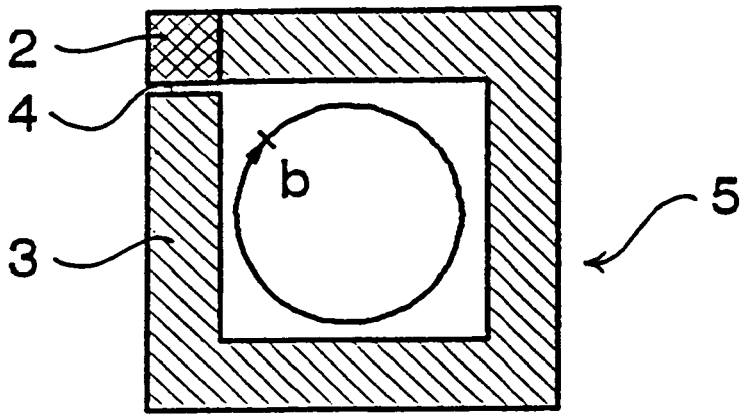
FIG. 2 is a plan view of the upper conducting track in accordance with a preferred embodiment of the security element of the invention.

FIG. 2 shows a plan view of an upper conducting track 5. The upper conducting track 5 is likewise stamped out from an aluminum foil and has the same dimensions as the lower conducting track 1. With the security element assembled, the contact zone 2, which is also provided on the upper conducting track 5, establishes an electrical connection between the lower conductor 1 and the upper conductor 5. The upper conducting track 5 is wound in the clockwise direction, with the angle of rotation "b" included by the coil turn 3 being likewise less than $2\pi$. In this embodiment the angles of rotation "a" and "b" included by both turns are hence less than $2\pi$ in each case, because at least a respective gap 4 has to be subtracted from the full turn of $2\pi$.

The thickness of the lower conducting track 1 and the upper conducting track 5 may be greater or smaller than the 38 $\mu$m mentioned above. The conducting tracks 1 and 5 may be produced by methods other than stamping. Stamping is a low cost method because the two conducting tracks 1 and 5 are relatively wide and of straightforward construction. A gap 4 is provided between the ends of the turns 3 and the contact zones 2. The entire lower conducting track 1 is then coated with a dielectric layer. This layer is omitted or weakened in the area of the contact zone 2.

Figure 3:
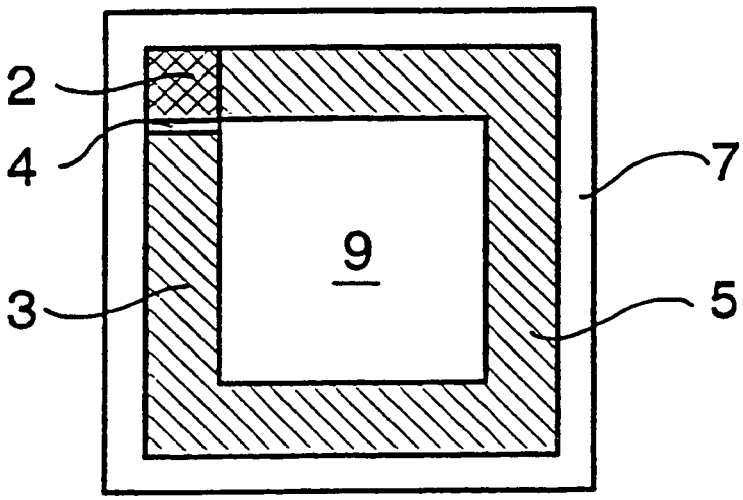
FIG. 3 is a plan view of a security element of the invention, which is composed of the conducting tracks illustrated in FIGS. 1 and 2.

FIG. 3 shows an embodiment of a security element of the invention, which is composed of the lower and the upper conducting track 1 and 5, respectively. In the area of the contact zone 2 an electrical contact exists between the two conducting tracks 1 and 5. In the remaining area a dielectric layer, not shown in FIG. 3, which is arranged between the lower conducting track 1 and the upper conducting track 5, provides for electric insulation of the conducting tracks 1 and 5.

The conducting tracks 1 and 5 and the dielectric layer are arranged on a carrier plate (backing) 7, which may have outer dimensions of typically 40 mm×40 mm and provides for the necessary mechanical stability of the security element.

Owing to the small number of turns of the conducting tracks 1 and 5, the surface area 9 enclosed by the turns is relatively large, which increases the magnetomotive force $\theta$. As a result of the increased magnetomotive force $\theta$, the effective volume $V_{eff}$ increases also.

In order to obtain the usual resonant frequency of 8.2 MHz, in spite of the small number of turns of the security element of the invention and the correspondingly low inductance L, it is necessary to increase the capacitance C of the security element correspondingly. This is accomplished by reducing the thickness of the dielectric layer between the lower conducting track 1 and the upper conducting track 5. In a security element of the invention the thickness of this layer is typically about 2 $\mu$m or less, while in prior art security elements it is from 3 $\mu$m to 4 $\mu$m thick. Etched RF security elements of the prior art have layer thicknesses of as much as from 30 $\mu$m to 50 $\mu$m.

In security elements of the prior art with outer dimensions of 40 mm×40 mm, the effective volume $V_{eff}$ is about 1.2 L to 1.3 L. In the security elements according to the invention, the effective volume $V_{eff}$ is about 1.5 L to about 1.6 L for the same surface area.

The increase in capacitance C furthermore makes the security element less sensitive to detuning, that is, to an alteration of the resonant frequency. Detuning occurs whenever the security element is brought into close proximity to a large electrically conducting mass. Between this electrically conducting mass and the conducting tracks 1 and 5 high dielectric losses occur, which alter the resonant frequency of the security element and reduce its Q factor. As a result, the effective volume $V_{eff}$ of the security element likewise diminishes. The above-mentioned electrically conducting mass may be a shoplifter's hand or body, the above-mentioned products with a high water content, or the like.

With the above mentioned etched security elements, the proximity of a hand may cause the Q factor to drop from values of between 50 and 80 to values of between 10 and 30. The resonant frequency may shift by 10% to 20%.

In contrast, with a security element according to the invention, the proximity of a hand causes the Q factor to drop by only about 10%, while the resonant frequency shifts by only about 1%. This means that the detection rate of the security element of the invention is not appreciably affected by a person's hand or some other electrically conductive mass. Even if the security element of the invention is enclosed by two hands, the detection rate is maintained at a high, nearly unchanged level.

Due to the selected dimensions of the carrier plate 7, the security element of the invention is, in addition, characterized by high mechanical stability.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A security element comprising a resonant circuit, said resonant circuit comprising a capacitor and an inductor, said inductor being formed using two conductive tracks having widths and lengths, a first conductive track separated from a second conductive track by a dielectric layer and with both tracks being electrically coupled at a common point, while simultaneously forming said capacitor and wherein said each of said conductive tracks comprises a uniform width along its length.

2. The security element of claim 1 wherein said security element comprises:

said first conductive track having a first contact zone in electrical communication with a first end of said first conductive track;

said second conductive track having a second contact zone in electrical communication with a second end of said second conductive track; and said dielectric layer interposed between said first and second conductive tracks and wherein said first and second contact zones are in electrical communication with each other, said first and second conductive tracks forming said inductor and said capacitor of said resonant circuit.

3. The security element of claim 1 wherein said inductor comprises a reduced length for increasing a quality factor of said security element.

4. The security element of claim 1 wherein said uniform widths of each of said conductive tracks are the same width.

5. The security element as claimed in claim 2 wherein said dielectric layer comprises an adhesive layer.

6. The security element as claimed in claim 2 wherein said dielectric layer comprises a dielectric film.

7. The security element as claimed in claim 6 wherein said dielectric film comprises polyethylene terephthalate.

8. The security element as claimed in claim 2 wherein said dielectric layer comprises a dielectric lacquer layer.

9. The security element as claimed in claim 2 wherein said dielectric layer has a thickness of not greater than about 2 $\mu$m.

10. The security element as claimed in claim 2 wherein said first and second contact zones are in electrical communication by perforations.

11. The security element of claim 2 wherein said first conductive track is oriented into a nearly-closed configuration in a first direction and wherein said second conductive track is oriented into a nearly-closed configuration in a second direction, opposite to said first direction.

12. A security element, comprising a resonant circuit, said resonant circuit comprising a capacitor and an inductor, said capacitor being formed using two conductive tracks having width and lengths, one track separated from the other track by a dielectric layer and with both tracks being electrically coupled at a common point, while simultaneously forming said inductor, and wherein said each of said conductive tracks comprises a uniform width along its length.

13. The security element of claim 12 wherein said inductor comprises a reduced length for increasing a quality factor of said tag.

14. The security element of claim 12 wherein said uniform widths of each of said conductive tracks are the same width.

15. The security element of claim 12 wherein each of said conductive tracks comprises a respective contact zone at a respective end of each of said conductive tracks and wherein said pair of conductive tracks are electrically coupled to each other through said dielectric layer via said respective contact zones, forming said common point.

* * * * *